US005704198A

United States Patent [19]

Beauchane

[11] Patent Number: 5,704,198

[45] Date of Patent: Jan. 6, 1998

[54] STIRRUP STRAIGHTENER CONNECTOR

[75] Inventor: Rollin P. Beauchane, 29600 S. Dryland Rd., Canby, Oreg. 97013

[73] Assignee: Rollin P. Beauchane, Canby, Oreg.

[21] Appl. No.: 778,298

[22] Filed: Jan. 2, 1997

[51] Int. Cl.[6] ..... B68C 1/16

[52] U.S. Cl. ..... 54/46.1

[58] Field of Search ..... 54/46.1, 46.2, 54/47

[56] References Cited

U.S. PATENT DOCUMENTS

| | | | |
|---|---|---|---|
| 425,184 | 4/1890 | Padgitt | 54/46.1 |
| 438,485 | 10/1890 | Padgitt . | |
| 482,996 | 9/1892 | Dacus | 54/47 |
| 699,472 | 5/1902 | Aughey et al. | 54/47 |
| 830,114 | 9/1906 | Turner | 54/47 |
| 1,174,712 | 3/1916 | Gunn | 54/47 |
| 2,532,082 | 11/1950 | Borst | 54/47 |
| 5,107,660 | 4/1992 | Mommeja et al. . | |

*Primary Examiner*—Robert P. Swiatek

*Attorney, Agent, or Firm*—Chernoff, Vilhauer, McClung & Stenzel

[57] ABSTRACT

A stirrup straightener connector perpendicularly connects a stirrup having a stirrup bar to a saddle strap. The connector includes a stirrup holder and a holder bar. The stirrup holder has a first side portion, an indentation portion, an angled portion angled toward the indentation portion, and a second side portion. The holder bar has two ends, each end interconnectable with a respective side portion.

15 Claims, 3 Drawing Sheets

20
22
25
4
24

22
26
25
24

STIRRUP STRAIGHTENER CONNECTOR

BACKGROUND OF THE INVENTION

The present invention relates to a stirrup straightener connector that causes a stirrup to inherently hang in a position perpendicular to the fender of a saddle.

A traditional saddle has a fender on each side of a horse that lays flat against the horse's side. As shown in FIG. 1, each fender 20 includes a strap 22 that engages a stirrup 24. As shown in FIG. 2, the stirrup 24 of a traditional saddle hangs parallel to the fender 20 and strap 22. However, when a rider puts his foot in the stirrup 24 as shown in FIG. 1, it causes the strap 22, and sometimes the fender 20, to twist until the stirrup 24 is perpendicular to its original position. The twisted leather of the fender 20 and strap 22 can easily chafe the sides of the horse. Also, since the rider must maintain the twist in order to sit properly in the saddle, the traditional interconnection between the strap 22 and the stirrup 24 tends to put pressure on the rider's ankles.

Recognizing this problem, others have attempted to develop interconnections between the strap 22 and the stirrup 24 that did not have the aforementioned problems. Some saddles, including the one disclosed in U.S. Pat. No. 438,485 to J. D. Padgitt, have been made that have straps that are fashioned to hold the stirrup in a perpendicular position. This, however, does not solve the problems of existing saddles as Padgitt's system is not retrofittable. Also, since perpendicular stirrups are not allowed in riding competitions, the saddle would only be usable for pleasure riding and non-competitive uses.

Another example, U.S. Pat. No. 830,114 to E. M. Turner, discloses a coupling member that holds the stirrup perpendicular to the fender by putting the bar of the stirrup in a centrally located indentation both forward and backward. In use, however, the stirrup bar would tend to bounce out of the indentation. Another problem is that the rider would have to push his foot too far forward for maximum comfort so that, at the very least, the metal edge of the Turner device would tend to rub against the riders shin.

Another problem with the Turner device is that there is a gap between the short bars that connect the Turner device to the strap. To prevent the Turner device from falling off the strap it must be laced into position. Of course, if the laces brake or become untied, the Turner device would slip off the strap.

Other references such as U.S. Pat. No. 1,174,712 to C. A. H. Gunn patent and U.S. Pat. No. 2,532,082 to F. C. Borst have a pivot feature which would cause the rider's ankle to twist as he rode. At the very least, this pivoting feature would prevent optimal control of the horse and, more likely would be dangerous. Also, these references position the stirrup at a central location similar to the Turner device. As discussed above, this centralized location has disadvantages that are detrimental to the rider.

BRIEF SUMMARY OF THE INVENTION

A stirrup straightener connector of the present invention perpendicularly connects a stirrup having a stirrup bar to a saddle strap. The connector includes a stirrup holder and a holder bar. The stirrup holder has a first side portion, an indentation portion, an angled portion angled toward the indentation portion, and a second side portion. Preferably the indentation and angled portions are positioned between the first and second side portion. The holder bar has two ends, each end interconnectable with a respective side portion.

Because the indentation portion is perpendicular to the stirrup holder bar, when the stirrup bar rests within the indentation portion the stirrup hangs perpendicular to the saddle strap.

The stirrup straightener connector of the present invention makes it unnecessary to twist the stirrup and fender. This tends to alleviate stress on a rider's ankles. Further, the stirrup straightener connector of the present invention is off center. This tends to alleviate stress on a rider's knees.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
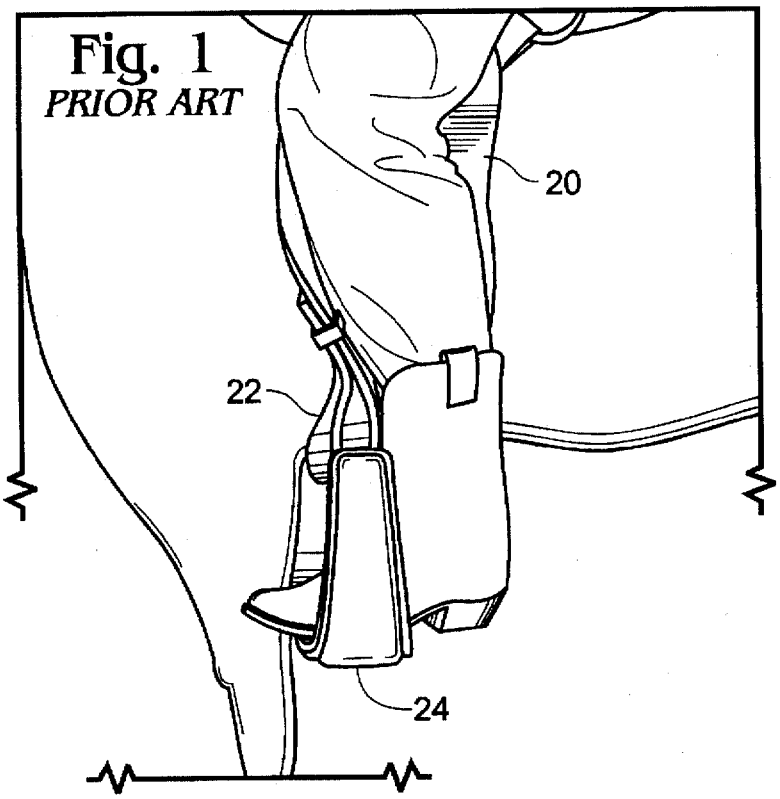
Fig. 1 PRIOR ART
FIGS. 1 and 2 show a prior art coupling between a saddle strap and a stirrup.
Figure 2:
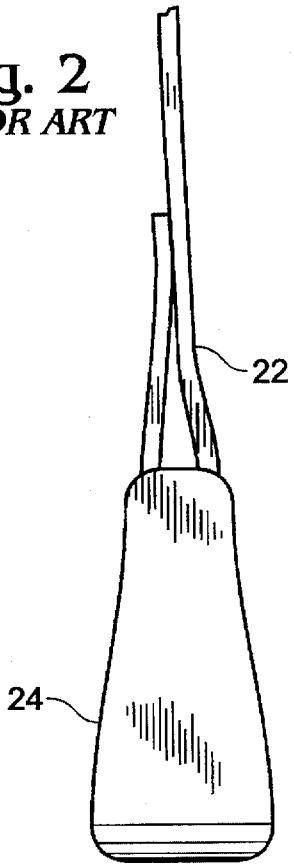
Fig. 2 PRIOR ART
Figure 5:
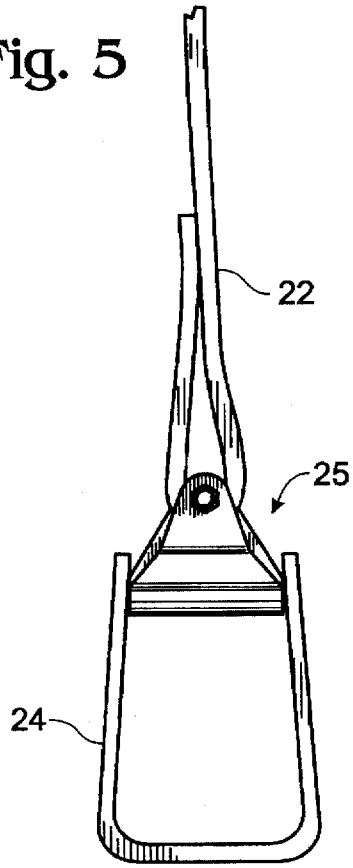
FIG. 5 is a front view of the natural hanging position of a coupling between a saddle strap and a stirrup using the stirrup straightener connector of the present invention.
Figure 3:
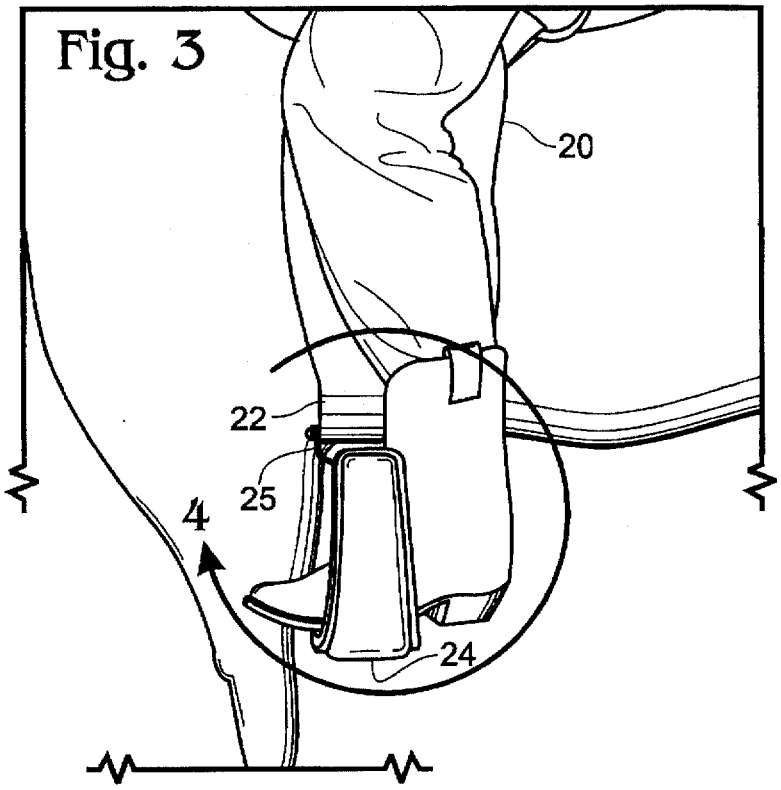
FIG. 3 is a side view of a coupling between a saddle strap and a stirrup using a stirrup straightener connector of the present invention.
Figure 4:
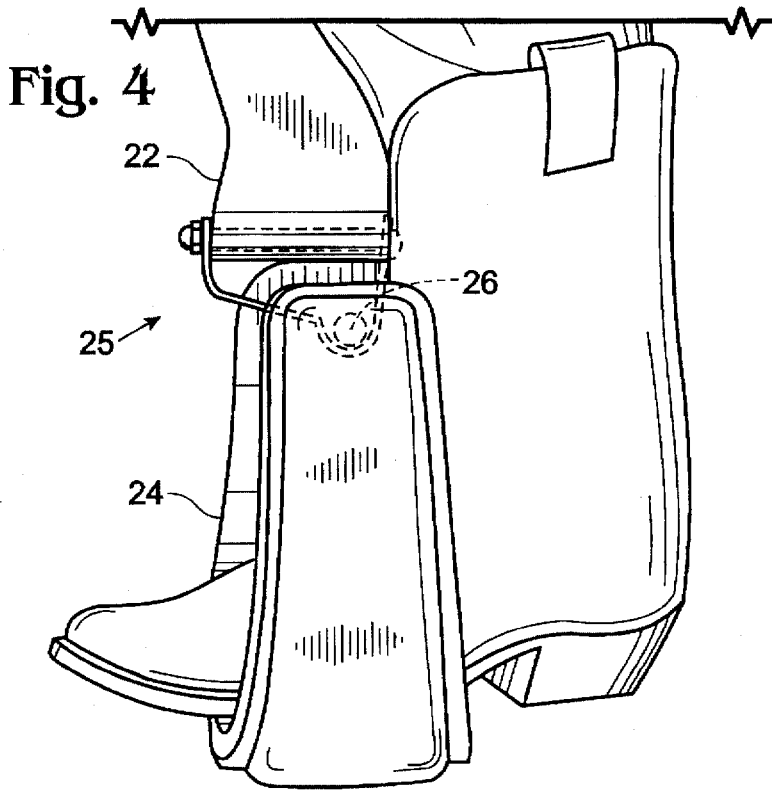
FIG. 4 is an enlarged side view of the coupling shown in FIG. 3.
Figure 6:
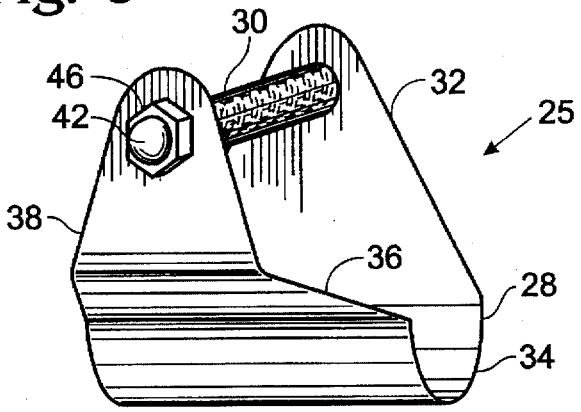
FIGS. 6–10 are different views of the stirrup straightener connector of the present invention.
Figure 7:
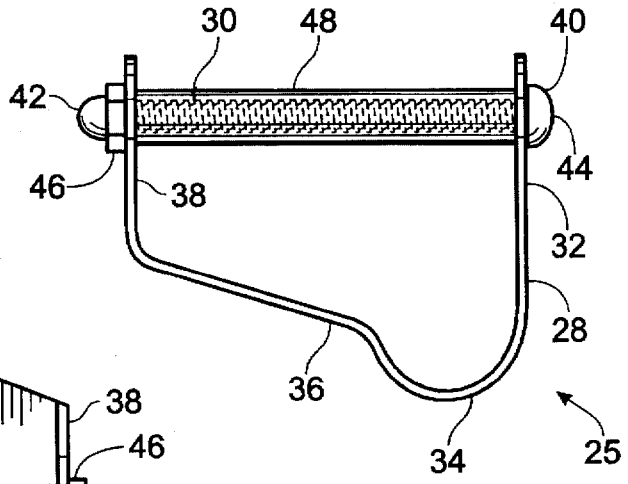
Figure 8:
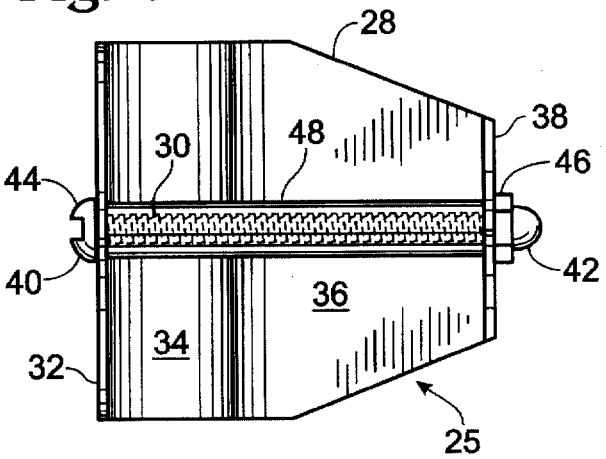
Figure 9:
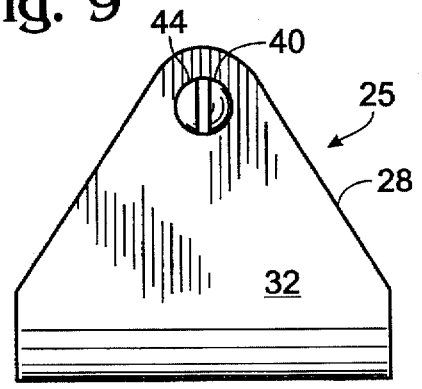
Figure 10:
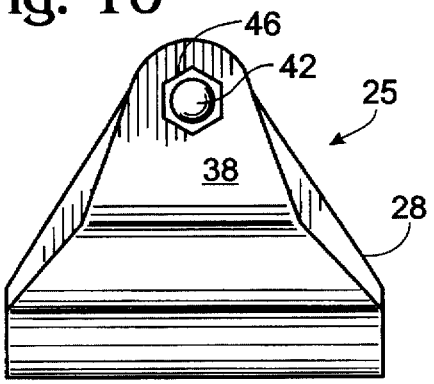

As shown in FIGS. 3–5, the present invention is directed to a stirrup straightener connector 25 for coupling a stirrup 24 having a stirrup bar 26 (shown in phantom in FIG. 4) to a saddle strap 22 so that the stirrup 24 hangs perpendicularly to the strap 22 and fender 20 of a saddle.

More specifically, as shown in FIGS. 6–10, the stirrup straightener connector 25 is comprised of a stirrup holder 28 and a holder bar 30.

The stirrup holder 28 is preferably an integral piece of bent metal. Alternatively, the stirrup holder 28 may be molded metal, molded plastic, or other sturdy and durable material. The stirrup holder 28 may be divided into four portions for reference: a first side portion 32, an indentation portion 34, an angled portion 36, and a second side portion 38.

In the shown embodiment, the indentation and angled portions 34, 36 are positioned between the first and second side portions 32, 38. Further, as shown, the first and second side portions 32, 38 are preferably parallel. It should be noted, however, that the side portions 32 and 38 may be angled slightly if desired. Still further, preferably the first side portion 32 is longer than the second side portion 38.

The indentation portion 34 is constructed to engage the stirrup bar 26. Accordingly, the indentation portion 34 preferably has a smooth, rounded shape that allows the stirrup bar 26 to pivot or swivel forward and backward within the indentation portion 34.

Because of the depth of the indentation portion 34, the stirrup bar 26 will generally not fall out of or escape from the indentation portion 34. On one side of the indentation portion 34 is the first side portion 32 that is generally perpendicular to the indentation portion 34, thus the stirrup bar 26 could not escape in that direction. On the other side of the indentation portion 34 is the angled portion 36 that is preferably adjacent to and integral with the indentation portion 34. The angled portion 36 is preferably angled downward toward the indentation portion 34. Accordingly, if the stirrup bar 26 was to bounce out of the indentation portion 34, it would slide downward on the angled portion 36 and back into the indentation portion 34.

Having the indentation portion 34 adjacent to the side portion 32 has another advantage that is not present in the prior art. When the stirrup 24 is correctly hung using the stirrup straightener connector 25 of the present invention, the indentation portion 32 is close to the rider's leg (FIGS. 3 and 4). This position is optimal for rider comfort and control. Also, the forward position of the indentation portion 32, and thus the stirrup 24, helps alleviate stress in a rider's knees.

As mentioned above, the stirrup straightener connector 25 also includes a holder bar 30 that, when in use, is pivotably interconnected to the saddle strap 22. The holder bar 30 generally has a first holder bar end 40 interconnectable to the first side portion 32 and a second holder bar end 42 interconnectable to the second side portion 38. As shown, the holder bar 30 is a bolt having a head 44 at the first holder bar end 40 and a fastener such as a nut 46 at the second holder bar end 42. The holder bar 30 may also include a tube 48 through which the body of the bolt is inserted. The tube 48 both protects the strap 22 from excessive wear and prevents the nut 46 from being screwed too tightly onto the bolt which, if extreme pressure was used, could cause the first and second side portions 32, 38 to bend inward if the tube 48 was not present between the first and second side portions 32, 38.

Although the above disclosure sets forth that the first holder bar end 40 is interconnectable to the first side portion 32 and the second holder bar end 42 is interconnectable to the second side portion 38, it should be noted that the first holder bar end 40 could be interconnectable to the second side portion 38 and the second holder bar end 42 could be interconnectable to the first side portion 32.

The stirrup straightener connector 25 is preferably interposed between the stirrup bar 26 of a stirrup 24 and a saddle strap 22 using a simple method. First, the stirrup bar 26 is placed into the indentation portion 34 of the stirrup holder 28. Second, the first holder bar end 40 of the holder bar 30 is inserted into an aperture (not shown) of the first side portion 32 of the stirrup holder 28. Optionally, the body of the holder bar 30 may then be inserted through a tube 48. Third, the second holder bar end 42 of the holder bar 30 is inserted into an aperture (not shown) in the second side portion 38 of the stirrup holder 28. Fourth, the second holder bar end 42 is secured with a fastener 46. Finally, the stirrup holder 28 may be hung from the saddle strap 22 in a manner that uses the holder bar 30 like the stirrup bar 26 of a traditional saddle. However, because the indentation portion 34 in which the stirrup bar 26 now rests is perpendicular to the holder bar 30, the stirrup 24 hangs perpendicular to the strap 22 and fender 20.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A stirrup straightener connector for connecting a stirrup with a stirrup bar to a saddle strap, said connector comprising:

(a) an integral stirrup holder comprising:

(i) first and second side portions;

(ii) an indentation portion for engaging said stirrup bar, said indentation portion integral with said first side portion, and;

(iii) an angled portion adjacent to and integral with said indentation portion, said angled portion angled toward said indentation portion, said angled portion integral with said second side portion; and (b) a holder bar having a first holder bar end and a second holder bar end, said first holder bar end interconnectable to said first side portion, and said second holder bar end interconnectable to said second side portion.

2. The connector of claim 1 wherein said indentation portion is perpendicular to said holder bar.

3. The connector of claim 1, said holder bar comprising:

(a) a bolt having a first bolt end and a second bolt end, said bolt having a head at said first bolt end;

(b) a tube, said bolt inserted into said tube; and (c) a fastener, said fastener interconnectable to said second bolt end.

4. The connector of claim 3 wherein said first bolt end is interconnectable with said first side portion and said second bolt end is interconnectable with said second side portion.

5. The connector of claim 1 wherein said first side portion is longer than said second side portion.

6. The connector of claim 1 wherein said first side portion is parallel to said second side portion.

7. The connector of claim 1 wherein said integral stirrup holder is made from a single piece of sturdy metal.

8. A stirrup holder system for perpendicularly connecting a stirrup with a stirrup bar to a saddle strap, said system comprising:

(a) a stirrup holder with a first side portion, an indentation portion, an angled portion angled toward said indentation portion, and a second side portion, said indentation and angled portions positioned between said first and second side portions;

(b) a holder bar having two ends, each end interconnectable with a respective side portion.

9. The system of claim 8, said holder bar comprising:

(a) a bolt having a first bolt end and a second bolt end, said bolt having a head at said first bolt end;

(b) a tube, said bolt inserted into said tube; and (c) a fastener, said fastener interconnectable to said second bolt end.

10. The system of claim 9 wherein said first bolt end is interconnectable with said first side portion and said second bolt end is interconnectable with said second side portion.

11. The system of claim 8 wherein said first side portion is longer than said second side portion.

12. The system of claim 8 wherein said first side portion is parallel to said second side portion.

13. The system of claim 8 wherein said indentation portion is perpendicular to said holder bar.

14. A method of hanging a stirrup with a stirrup bar perpendicularly to a saddle strap, said method comprising:

(a) placing the stirrup bar into an indentation portion of a stirrup holder;

(b) inserting a first holder bar end of a holder bar into a first side portion of said stirrup holder;

(c) inserting a second holder bar end of said holder bar into a second side portion of said stirrup holder;

(d) securing said second holder bar end with a fastener; and (e) hanging said stirrup holder from said saddle strap from said holder bar so that said stirrup bar rests within said indentation portion.

15. The method of claim 14 further comprising the step of threading said holder bar through a tube between steps (c) and (d).

* * * * *